US007150146B2

(12) United States Patent
Blaschke et al.

(10) Patent No.: US 7,150,146 B2
(45) Date of Patent: Dec. 19, 2006

(54) METHOD OF OPERATING AN EXHAUST GAS TREATMENT SYSTEM FOR AN INTERNAL COMBUSTION ENGINE

(75) Inventors: Walter Blaschke, Deizisau (DE); Günter Eberspach, Wolfschlugen (DE); Gerd Gaiser, Reutlingen (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 0 days.

(21) Appl. No.: 10/992,139

(22) Filed: Nov. 18, 2004

(65) Prior Publication Data

US 2005/0109019 A1 May 26, 2005

(30) Foreign Application Priority Data

Nov. 20, 2003 (DE) ..... 103 54 232

(51) Int. Cl.
*F01N 3/00* (2006.01)

(52) U.S. Cl. ..... 60/286; 60/274; 60/300; 60/303

(58) Field of Classification Search ..... 60/274, 60/284, 286, 300, 303
See application file for complete search history.

(56) References Cited

U.S. PATENT DOCUMENTS 3,724,220 A * 4/1973 Tanasawa et al. ..... 60/303
3,759,668 A * 9/1973 Yamada et al. ..... 422/176
3,813,879 A * 6/1974 Inoue et al. ..... 60/303
3,828,736 A * 8/1974 Koch ..... 123/3
3,837,814 A * 9/1974 Tanasawa et al. ..... 60/290
4,545,758 A 10/1985 Nakamura et al.
4,566,271 A * 1/1986 French et al. ..... 60/286
4,576,617 A * 3/1986 Renevot ..... 95/279
5,419,121 A * 5/1995 Sung et al. ..... 60/274
5,665,318 A * 9/1997 Rembold et al. ..... 422/177
5,826,428 A * 10/1998 Blaschke ..... 60/303
5,829,248 A * 11/1998 Clifton ..... 60/286
2004/0035101 A1* 2/2004 Imai et al. ..... 60/295

FOREIGN PATENT DOCUMENTS

DE 33 18 634 C2 1/1983
DE 195 04 183 A1 9/1995

* cited by examiner

*Primary Examiner*—Thomas Denion
*Assistant Examiner*—Diem Tran

(57) ABSTRACT

An exhaust gas treatment system for an internal combustion engine, particularly a diesel internal combustion engine having a catalyst arrangement and also at least one evaporator/burner arrangement upstream of the catalyst arrangement in the exhaust gas flow path, the evaporator/burner arrangement including a housing arrangement, with an evaporator/burner chamber formed therein which is open to the exhaust gas flow path, an evaporator medium for receiving liquid hydrocarbon and for delivering hydrocarbon vapor to the evaporator/burner chamber, a heating device for heating the evaporator medium, and an ignition device for starting the combustion of the hydrocarbon vapor present in the evaporator/burner chamber.

1 Claim, 1 Drawing Sheet

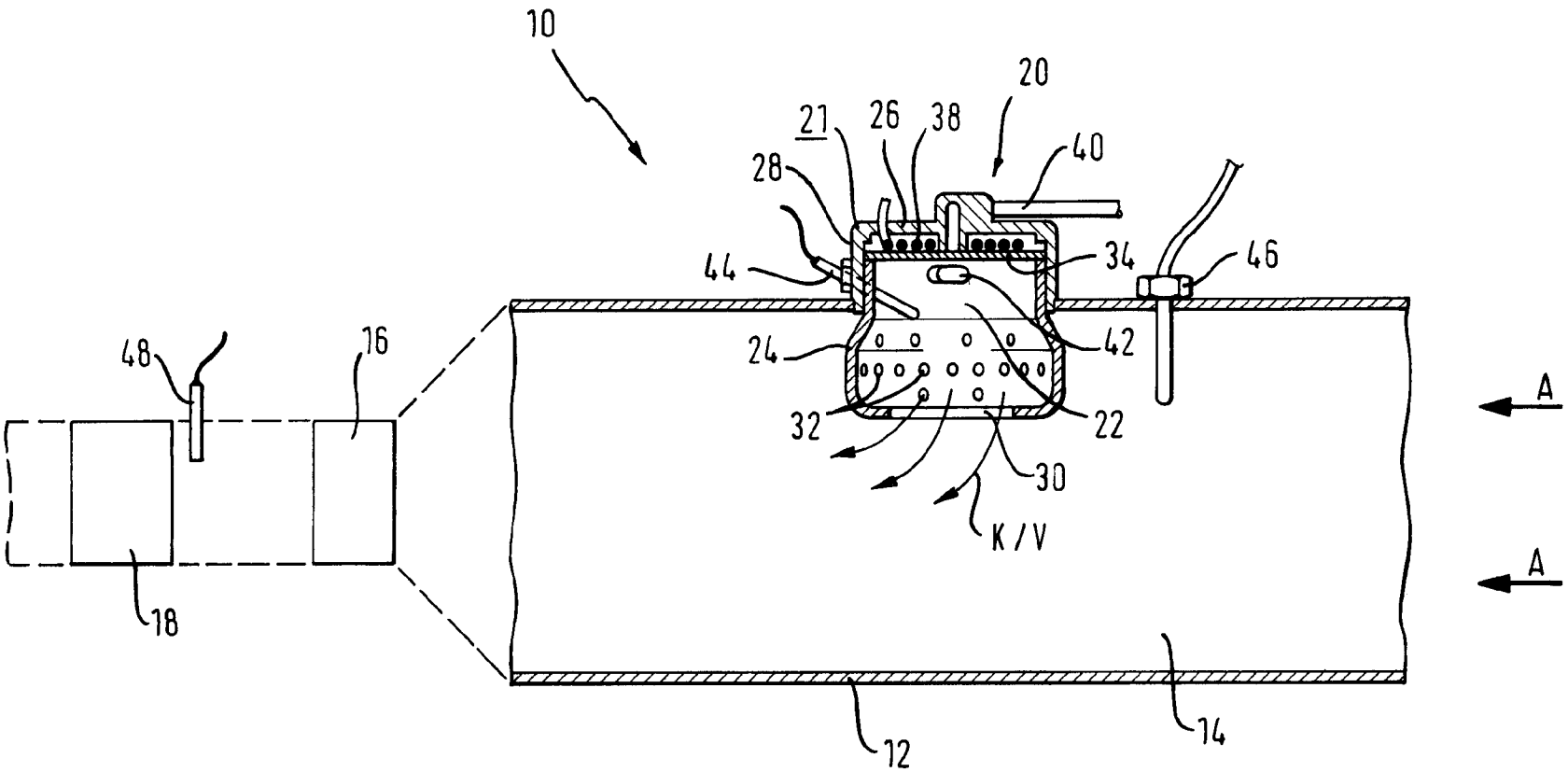
Fig.

METHOD OF OPERATING AN EXHAUST GAS TREATMENT SYSTEM FOR AN INTERNAL COMBUSTION ENGINE

CROSS-REFERENCES TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not Applicable.

BACKGROUND OF THE INVENTION

1. Field of the Invention

The present invention relates to an exhaust gas treatment system for an internal combustion engine, particularly a diesel engine, including a catalyst arrangement.

2. Description of Related Art Including Information Disclosed Under 37 CFR 1.97 and 1.98

In such exhaust gas treatment systems, the exhaust gas leaving an internal combustion engine is substantially purified by the catalyst arrangement from the pollutants which are particularly damaging to the environment. This exhaust gas contains, in particular, high proportions of nitrogen oxides and carbon monoxide, which are substantially converted by a catalytic reaction into carbon dioxide. Particularly in diesel internal combustion engines, soot particles also arise in such a catalytic reaction or in the combustion.

In order to start or maintain this catalytic reaction, a temperature is required which lies in the region of at least 200–250° C., according to the catalyst construction and material. If the catalyst temperature falls below a so-called "light-off temperature" situated in this region, it can no longer maintain, or respectively start, a catalytic reaction suitable for the required pollutant reduction. Such a fall in temperature in the catalyst region can, for example, arise when the exhaust gases leaving the internal combustion engine do not transport sufficient heat to be able to ensure a corresponding heating of the catalyst. This can be the case, for example, in idling operation, in which the temperature of the exhaust gases is in the region of 150° C. Particularly critical as regards a suitable catalytic reaction are therefore the starting phase of an internal combustion engine or also phases during travel in which travel is with low load, thus, for example, in lengthy downhill travel or when moving slowly on motorways, etc.

In order to prevent the soot particles transported in the exhaust gas of a diesel engine being ejected into the environment, efforts are being made to follow the catalysts with particle filters which can substantially filter out these soot particles from the exhaust gases ejected to the outside. However, the problem here is substantially that during the operating period these particle filters become choked with soot. It is therefore necessary to undertake a cleaning or regeneration from time to time. This can be performed, for example, by oxidation with nitrogen dioxide at a corresponding temperature, or by supplying additives and corresponding heating. However, the problem exists with all of these heretofore known cleaning methods that comparatively high temperatures of up to 400° C. are required, in order to ensure a suitable cleaning of the particle filter from the soot particles collected there. However, if the exhaust gas temperature of an internal combustion engine falls, or if this temperature is not high enough to start or maintain the said catalytic reaction, then lacking an ongoing catalytic reaction in the catalyst, also sufficient heating does not arise for so strongly heating the exhaust gases flowing toward the particle filter that the desired regeneration can be performed in the particle filter.

BRIEF SUMMARY OF THE INVENTION

The object of the invention is to provide an exhaust gas treatment system for an internal combustion engine, in particular a diesel internal combustion engine, and also a method for operating such an exhaust gas treatment system, with which in a satisfactory manner a low pollutant emission can be sought, even over the lifetime of such a system.

According to a first aspect of the present invention, this object is attained by an exhaust gas treatment system for an internal combustion engine, particularly a diesel internal combustion engine, comprising a catalyst arrangement and also at least one evaporator/burner arrangement downstream of the catalyst arrangement in the exhaust gas flow path, wherein the evaporator/burner arrangement comprises: a housing arrangement with an evaporation/burner chamber formed therein and open to the exhaust gas flow path, an evaporator medium for receiving liquid hydrocarbon and for delivering hydrocarbon vapor to the evaporator/burner chamber, a heating device for heating the evaporator medium, an ignition device for starting the combustion of the hydrocarbon vapor present in the evaporator/combustion chamber.

Care can be taken, by providing at least one evaporator/burner arrangement, that when the temperature of the exhaust gases flowing toward the catalyst arrangement is not sufficient to start or maintain the auto-thermic catalytic reaction there, an additional combustion is started by means of which, on the one hand, combustion exhaust gases are produced which have a very high temperature and, on the other hand, the exhaust gases flowing in from the internal combustion engine can be heated, so that then, by corresponding heat transfer, the temperature of the catalyst arrangement or respectively of the catalyst material itself can be raised above the so-called light-off temperature or can be kept above this temperature. If the temperature of the exhaust gases flowing from the internal combustion engine is high enough, the evaporator/burner arrangement to be provided according to the invention can for example be operated so that only liquid hydrocarbon, thus in general fuel, can be evaporated in order to admix this with the exhaust gases and thus to effect an improved catalytic reaction.

In an embodiment which is preferred constructionally and also particularly preferred on cost grounds, the heating device can be an electrically operable heating device, but it can also comprise a heating coil chamber, heating spiral, or the like.

It can, for example, be provided in the system according to the invention that the evaporator medium is provided at least in the floor region of the substantially pot-shaped housing arrangement, and that the heating device is provided in the floor region of the housing arrangement.

In order to make it possible for the materials collecting in the evaporation/combustion chamber to enter the exhaust gas stream, it is furthermore proposed that the housing arrangement has an opening situated opposite the floor region for the exit of the hydrocarbon vapor produced in the evaporation/combustion chamber to the exhaust gas stream path and/or of the combustion products produced in the evaporation/combustion chamber to the exhaust gas flow path.

Particularly in operation as an additional heat source for the catalyst arrangement, the evaporator/burner arrangement to be provided according to the invention requires oxygen in order to be able to burn the hydrocarbon vapor produced there. For this purpose, according to a further aspect of the invention, the residual oxygen transported by the exhaust gases flowing out of the internal combustion engine is used, so that no additional combustion air fans or the like have to be provided. In order however to bring this oxygen into those regions in which the combustion is to proceed, it is furthermore proposed that a peripheral wall of the housing arrangement projects into the exhaust gas flow path and has an exhaust gas passage aperture arrangement.

The operation of the evaporator/burner arrangement for producing hot combustion gases is only required, as previously mentioned, when the exhaust gases flowing from the internal combustion engine are not sufficiently hot. It is therefore furthermore proposed that a first temperature sensor arrangement is provided for determining a temperature of the exhaust gases leaving an internal combustion engine, upstream of the catalyst arrangement in the exhaust gas flow path. Also, for example, in particular during the combustion operation of the evaporator/burner arrangement, in order to allow knowing that the temperature of the exhaust gases emitted from the internal combustion engine has risen, for example, because of a load change, it is further proposed that the first temperature sensor arrangement is provided upstream of the at least one evaporator/burner arrangement.

As already previously mentioned, a particle filter can be provided in such an exhaust gas treatment system, downstream of the catalyst arrangement in the exhaust gas flow path, particularly for use in connection with a diesel internal combustion engine. The aspect to be provided according to the invention of additional heating of the exhaust gases emitted by the internal combustion engine, particularly with the combination of a catalyst arrangement with a particle filter arrangement, is particularly important, since thus also when the exhaust gas temperature is not sufficient for maintaining or starting the auto-thermic catalytic reaction in the catalyst arrangement, and insofar as the required high temperatures for regeneration of the particle filter also cannot be provided in the catalyst arrangement, a suitable catalysis, and consequently also a suitable particle filter regeneration, can be taken care of by operation of the evaporator/burner arrangement.

Furthermore it can be provided according to the invention that a second temperature sensor arrangement is provided upstream of the particle filter arrangement, for determining the exhaust gas temperature in the flow path region between the catalyst arrangement and the particle filter arrangement. This second temperature sensor arrangement can also be used for reaching a decision concerning the operation of the evaporator/burner arrangement as a burner or as an evaporator. Namely, if it is known that the temperature of the exhaust gases flowing onto the particle filter arrangement is not sufficiently high to perform particle filter regeneration, this is an indication that also in the catalyst arrangement the catalytic reaction is not proceeding, or is not proceeding in a suitable manner. Care can thus furthermore be taken, by raising the temperature of the exhaust gases flowing from the internal combustion engine, that the two said purification processes can proceed in an optimum manner in the catalyst arrangement or respectively in the particle filter arrangement.

According to a further aspect of the present invention, the abovementioned object is attained by a method of operating an exhaust gas treatment system according to the invention, in which method, when it is found that an exhaust gas temperature of the exhaust gases leaving an internal combustion engine is below a predetermined threshold value, and in particular is not sufficiently high to start and/or maintain a suitable catalytic reaction in the catalyst arrangement, the at least one evaporator/burner arrangement is operated at least in phases for the combustion of at least a portion of the hydrocarbon vapor produced therein.

In this method it can further be provided that when it is found that the exhaust gas temperature of the gases leaving the internal combustion engine is above a predetermined threshold, and in particular is sufficiently high to start and/or maintain a suitable catalytic action in the catalyst arrangement, the at least one evaporator/burner arrangement is operated at least in phases to produce hydrocarbon vapor to be mixed with the exhaust gases of the internal combustion engine.

BRIEF DESCRIPTION OF THE DRAWING

The present invention is described in detail hereinafter with reference to the accompanying drawing. This shows an exhaust gas treatment system according to the invention, partially in longitudinal section and partially shown only schematically.

DETAILED DESCRIPTION OF THE INVENTION

The exhaust gas treatment system 10 according to the invention comprises an exhaust gas flow path 14 provided by a pipe duct arrangement generally denoted by 12 through which the exhaust gases denoted by the flow arrow A, emitted by an internal combustion engine (not shown), are conducted from the internal combustion engine to an outlet aperture (likewise not shown) where these exhaust gases are then ejected to the outside. The exhaust gases A are conducted via a catalyst arrangement, generally denoted by 16, to a particle filter arrangement 18. Basically an exothermic catalytic reaction, in which nitrogen oxides and carbon monoxide and also the hydrocarbon present in the exhaust gases A are substantially converted into carbon dioxide, takes place in the catalyst arrangement 16. Soot particles produced in this and in the internal combustion engine flow together with the exhaust gases leaving the catalyst arrangement 16 toward the particle filter arrangement 18 and are mechanically filtered out there. Exhaust gases substantially freed from soot particles, and containing carbon dioxide as main constituent, are then ejected to the surroundings.

In order to be able to start or maintain this catalytic reaction in the catalyst arrangement 16, it is necessary to raise the temperature of the latter or of the catalyst material therein to a region of 200–250° C. and keep it there. Only then is it possible to start this catalytic reaction, which is an exothermic reaction and liberates additional heat. This heat liberated by the catalytic reaction leads to both the catalyst arrangement 16 and in particular also the exhaust gases flowing toward the particle filter arrangement having a temperature of about 400° C. and higher. This temperature is required in order to combust, i.e., oxidize, the soot particles filtered out in the particle filter arrangement 18, and thus to clean the particle filter 18. This means that if an exothermic catalytic reaction does not take place in the catalyst arrangement 16, it is likewise not possible to clean the particle filter arrangement 18 from the soot particles collected there. This state can occur when the exhaust gases A have such a low temperature that the catalyst arrangement 16 cannot be brought to the required temperature in the range of 200–250° C. For example, when an internal combustion engine such as e.g. a diesel internal combustion engine idles, in general an exhaust gas temperature of 150° C. is obtained. In the unloaded travel state also, or in the travel state with small load, it can happen that the exhaust gas temperature does not reach the region of 200° C. The consequence of this is that the catalytic reaction in the catalyst arrangement 16 does not start or can die out, or a suitable catalysis can no longer take place, with the previously described consequences.

In order to counter this problem, in the exhaust gas treatment system 10 according to the invention, a evaporator/burner arrangement generally denoted by 20 is provided upstream of the catalyst arrangement 16 in the exhaust gas flow path 14. This evaporator/burner arrangement 20 comprises a housing arrangement 21 in which an evaporator/burner chamber 22 is formed. The housing arrangement 21 is of substantially pot-like design, and includes in the example shown a housing portion 24 substantially providing a peripheral wall and also a housing portion 28 substantially providing a floor region 26 and regionally engaging over the housing portion 24. At the region situated opposite the floor region 26, the housing has an aperture 30 opening the evaporator/burner chamber 22 to the exhaust gas flow path 14. As further described herein below, products arising in the evaporator/burner chamber 22 can get into the exhaust gas flow path 14 in the region of this aperture 30. Furthermore, passage openings 32 are provided in the region of the housing portion 24 projecting into the exhaust gas flow path 14, and through them on the one hand the said products from the evaporator/burner chamber 22 can emerge, and on the other hand, however, the exhaust gases A emitted by the internal combustion engine can enter this evaporator/burner chamber 22.

The floor region 26 of the housing arrangement 21 is covered with an evaporator medium 34 in the direction of the evaporator/burner chamber 22. This evaporator medium 34 is constructed of porous material which conveys liquid fuel or liquid hydrocarbon by capillary action. Non-woven material, netting, fabric, foam ceramic or the like may be used, for example. A heating device 38 is provided, allocated to this evaporator medium 34 on the side remote from the evaporator/burner chamber 22. In the case shown, this includes, for example, a heating spiral which is controlled by a controller (not shown) and when excited results in heating of the evaporator medium 34. Furthermore, a fuel duct 40 opens into the housing portion 28, and liquid fuel, thus liquid hydrocarbon such as diesel oil or gasoline, can be fed thereby into the evaporator medium 34. A metering pump under the control of the abovementioned controller can be used for this feeding-in. Feeding such liquid fuel into the evaporator medium 34 has the consequence that this liquid fuel 34 is distributed comparatively uniformly over the whole evaporator medium 34 by capillary action and in particular is also conveyed to the side thereof facing the evaporator/burner chamber 22. By exciting the heating device 38 and thus increasing the temperature in the region of the floor region 26 or of the evaporator medium 34, it can be ensured that above all at comparatively low environmental temperatures an increased evaporation of the at first still liquid fuel occurs in the direction of the evaporator/burner chamber 22 when required.

In order to make combustion possible in the evaporator/burner chamber 22 of the collected fuel vapor, an ignition element 42 is provided. This can extend at a small distance from the evaporator medium 34 into the evaporator/burner chamber 22. The ignition element 42 can also be excited electrically, so that for example with excited heater device 38 and excited ignition element 42, on the one hand the required amount of fuel vapor and on the other hand the required temperatures in a locally limited region to start a combustion can be provided. In order to know whether such combustion was started or possibly was extinguished again, a so-called flame monitor 44, for example in the form of a temperature sensor, can be provided.

It can furthermore be seen in the FIGURE that the exhaust gas treatment system 10 according to the invention has two temperature sensors 46, 48 in the exhaust gas flow path 14. The temperature sensor 46 is arranged upstream of the evaporator/burner arrangement 20 in order to measure the temperature of the exhaust gases A flowing thereon. The temperature sensor 48 is arranged upstream of the particle filter arrangement 18 in order to determine the temperature of the exhaust gases flowing onto the particle filter arrangement 18. These temperature sensors 46, 48 also supply their sensor signals, as does the flame monitor 44, to the control device (not shown).

The operation of the exhaust gas treatment system 10 whose constructional details are explained hereinabove is described hereinafter.

It is first assumed that an internal combustion engine which is combined with such an exhaust gas treatment system 10 is operating in a normal operating state, i.e., under load. As a result, the exhaust gases A flowing in the exhaust gas flow path 14 have a comparatively high temperature, which can also be determined by the temperature sensor 46. The temperature will be sufficient to be able to provide a sufficiently high temperature in the catalyst arrangement 16 and to be able to perform there the said exothermic catalytic reaction. As a result, the exhaust gases leaving the catalyst arrangement 16 and flowing toward the particle filter arrangement 18 have such a high temperature, for example in the range of 400° C. and higher, so as to perform a continuous regeneration of the particle filter 18, and thus a substantially continuous burning-off of the soot particles collected there. In this state, the temperature sensor 48 will also give a signal which indicates that the exhaust gas temperature is sufficient for particle filter regeneration.

In order to support, or to permit to proceed in an optimized manner, the catalytic reaction in the catalyst arrangement 16, the evaporator/burner arrangement 20 shown in the FIGURE is activated in this operating phase so that it produces hydrocarbon vapor K and delivers this hydrocarbon vapor K substantially through the aperture 30 into the exhaust gas flow path 14. The hydrocarbon vapor K will be mixed with the exhaust gases A and react with these on the catalyst material of the catalyst arrangement 16. The required amount of hydrocarbon vapor K, which can also be substantially set by the operation of the metering pump (not described), or by means of the evaporation rate which can be set by exciting the heating device 38, can be determined from the operating state of the internal combustion engine, i.e., for example, from the load state and/or the rpm. This operating state will also substantially determine the composition of the emitted exhaust gases and thus also the required amount of hydrocarbon vapor.

If now, for example, it is found from the sensor signals of the temperature sensor 46 that the exhaust gas temperature is not sufficient to produce a suitable catalytic reaction in the catalyst arrangement 16, and consequently is not sufficient to perform a particle filter regeneration, and also, for example, a loading detection shows that the particle filter 18 is so heavily loaded with soot particles that a regeneration must be performed, the evaporator/burner arrangement 20 will now be operated as a burner. As regards the determination of loading, it may be stated that this can take place, for example, by the determination of the pressure before and after the particle filter 18, a large pressure difference indicating a correspondingly heavy loading of the particle filter 18. Other indicators may, of course, be used here to reach a decision concerning the required regeneration.

In order to start burner operation, liquid hydrocarbon or fuel is first fed into the evaporator medium 34 and the heating device 26 is simultaneously operated to ensure a sufficient fuel vapor concentration. For starting the combustion, the ignition element 42 is then excited, so that a correspondingly high temperature is produced locally in a region of high fuel vapor concentration and causes ignition. The oxygen necessary for the combustion is transported by the exhaust gases A in the form of residual oxygen, unused in the combustion in the internal combustion engine, and passes with the exhaust gases A through the openings 32 and possibly also the aperture 30 into the evaporator/burner chamber 22, and is mixed there with the fuel vapor. After successful ignition, which can be detected by the sensor signal of the flame monitor 44, the excitation of the ignition element 42 can be switched off. The excitation of the heating element 26 can also be switched off, since a sufficiently high temperature is produced by the combustion taking place in the evaporator/burner chamber 22 to maintain a sufficient evaporation of the at first still liquid hydrocarbon from the evaporator medium 34. With combustion proceeding, the combustion exhaust gases V of the evaporator/burner arrangement 20 then enter the exhaust gas flow path 14 substantially through the aperture 30 and are mixed there with the exhaust gases emitted by the internal combustion engine. This in its turn has the consequence that the exhaust gases then flowing toward the catalyst arrangement 16 have a higher temperature than in the region of the exhaust gas flow path 14 situated further upstream. The burner power can be adjusted by corresponding fuel metering so that also, on considering the temperature of the exhaust gases A in the region of the catalyst arrangement 16, a sufficiently high temperature can now be set to start or maintain the catalytic reaction. In order to provide for this, as described hereinabove, a given amount of hydrocarbon, the evaporator/burner arrangement 20 can be operated in this operation phase such that more fuel or hydrocarbon vapor is produced than is required for combustion with the residual oxygen flowing through this, transported in the exhaust gases A, so that not only combustion gases V but simultaneously also un-combusted hydrocarbon vapor K exit through the aperture 30.

By operation of the evaporator/burner arrangement 20 as a heat source in this phase, the respective required reaction takes place, or is kept taking place, both in the region of the catalyst arrangement 16 and also in the region of the particle filter arrangement 18.

If thereafter the temperature of the exhaust gases A rises further, for example due to a transition into a higher load state of the internal combustion engine, and in fact to a temperature which is sufficient to keep these reactions in existence, it is then no longer necessary to operate the evaporator/burner arrangement 20 in burner operation. With a suitable design of the housing arrangement 21, it can be sufficient that on going to a higher load state the combustion gases V are amplified and flow out at higher flow speed, so that the flame in the evaporator/burner chamber 22 is blown out, or the combustion dies out because of a low oxygen content in the exhaust gases A. This can again be detected by the flame monitor 44. It is of course also possible to end the combustion by correspondingly controlling the metering pump and corresponding fuel throttling. After the combustion has ended, the fuel supply can again be taken up or continued, in order to produce, with the furthermore operated heating device 26, the hydrocarbon vapor required or advantageous for the catalytic reaction and add it to the exhaust gases A.

If the exhaust gas temperature falls at a later time into a critical region again, the combustion process described hereinabove can be started again in the evaporator/burner arrangement 20, in that only the ignition element 42 is activated.

The system shown in the FIGURE and described hereinabove can of course be differently constructed in various aspects than shown and described, and can be operated in another manner. Thus it is of course possible, instead of the single evaporator/burner arrangement 20 to provide several of them in succession in the exhaust gas A flow direction and/or in the same positioning but distributed peripherally. Also the determination whether operation of this arrangement or arrangements 20 is required as a hydrocarbon vapor producer or as a burner or not at all can be found depending on other input magnitudes. Thus, for example, instead of the signal of the temperature sensor 46, that of the temperature sensor 48 can be evaluated to determine when the temperature is no longer sufficient to attain the desired catalytic reaction or cleaning reaction. Here, by the use if the signal of the sensor 48, another threshold value can be predetermined, falling below which shows that the catalytic reaction is no longer proceeding in the catalyst arrangement 16, meaning that this threshold element can or will be higher than for evaluation of the temperature sensor 46. It is also basically possible to determine the temperature of the exhaust gases A, not with sensors but, for example, by a performance characteristic in which range the temperature is. Here, for example, a performance characteristic could be defined which has the exhaust gas temperature as output quantity and for example the engine rpm and the engine load, or other relevant quantities, as input variables, for example. It is also possible, as regards the operation of the arrangement 20 as hydrocarbon vapor producer, to determine the residual oxygen proportion in the exhaust gases A by reading out a performance characteristic and then to determine on this basis the magnitude of the hydrocarbon vapor amount to be mixed with the exhaust gases A by evaporation, in order thus to obtain the desired catalytic reaction in the catalyst arrangement 16.

What is claimed is:

1. A method of operating an exhaust gas treatment system for an internal combustion engine, comprising:

a catalyst arrangement (16) and at least one evaporator/burner arrangement (20) upstream of the catalyst arrangement (16) in an exhaust gas flow path (14), the evaporator/burner arrangement including:

a housing arrangement (21) with an evaporator/burner chamber (22) formed therein and open to the exhaust gas flow path (14), an evaporator medium (34) for receiving liquid hydrocarbon and for delivering hydrocarbon vapor to the evaporator chamber (22), a heating device (38) for heating the evaporator medium (34), and an ignition device (42) for starting a combustion of the hydrocarbon vapor present in the evaporator/burner chamber (22), which method comprises the following step:

when it is determined that an exhaust gas temperature of the exhaust gases (A) leaving an internal combustion engine is under a predetermined threshold not sufficiently high to start or maintain a suitable catalytic reaction in the catalyst arrangement (16), operating the at least one evaporator/burner arrangement (20) at least in phases for combustion of at least a portion of the hydrocarbon vapor produced therein, wherein, when it is determined that the exhaust gas temperature of the exhaust gases leaving the internal combustion engine is above a predetermined threshold, sufficiently high to start or maintain a suitable catalytic reaction in the catalyst arrangement (16), operating the at least one evaporator/burner arrangement (20) at least in phases for producing hydrocarbon vapor to be mixed with the exhaust gases (A) of the internal combustion engine.

* * * * *